US011492747B2

(12) United States Patent
Li et al.

(10) Patent No.: US 11,492,747 B2
(45) Date of Patent: Nov. 8, 2022

(54) LAUNDRY TREATMENT APPARATUS

(71) Applicants: QINGDAO HAIER DRUM WASHING MACHINE CO., LTD., Shandong (CN); HAIER SMART HOME CO., LTD., Shandong (CN)

(72) Inventors: Wenwei Li, Shandong (CN); Zhiwei Zhao, Shandong (CN); Benfu Xing, Shandong (CN); Shaolei Yi, Shandong (CN); Leilei Ai, Shandong (CN); Jihui Pan, Shandong (CN)

(73) Assignees: QINGDAO HAIER DRUM WASHING MACHINE CO., LTD., Shandong (CN); HAIER SMART HOMEM CO., LTD., Shandong (CN)

( * ) Notice: Subject to any disclaimer, the term of this patent is extended or adjusted under 35 U.S.C. 154(b) by 176 days.

(21) Appl. No.: 16/969,140

(22) PCT Filed: Jan. 31, 2019

(86) PCT No.: PCT/CN2019/074143
§ 371 (c)(1),
(2) Date: Aug. 11, 2020

(87) PCT Pub. No.: WO2019/154260
PCT Pub. Date: Aug. 15, 2019

(65) Prior Publication Data

US 2021/0040665 A1 Feb. 11, 2021

(30) Foreign Application Priority Data

Feb. 12, 2018 (CN) ..... 201810144723.7

(51) Int. Cl.
*D06F 39/12* (2006.01)
*D06F 29/00* (2006.01)

(52) U.S. Cl.
CPC ..... *D06F 39/12* (2013.01); *D06F 29/005* (2013.01)

(58) Field of Classification Search
CPC ..... D06F 29/005; D06F 39/12
See application file for complete search history.

(56) References Cited

U.S. PATENT DOCUMENTS 10,584,440 B2 * 3/2020 Kim ..... D06F 58/206
2005/0115105 A1 6/2005 Ahn et al.
(Continued)

FOREIGN PATENT DOCUMENTS

CN 1504601 A 6/2004
CN 208151724 U 11/2018
(Continued)

OTHER PUBLICATIONS

International Search Report (PCT/ISA/210) dated May 8, 2019, by the Chinese Patent Office as the International Searching Authority for International Application No. PCT/CN2019/074143.
(Continued)

*Primary Examiner* — Matthew W Ing
(74) *Attorney, Agent, or Firm* — Buchanan Ingersoll & Rooney PC

(57) ABSTRACT

A laundry treatment apparatus, including a framework and a shell arranged on the framework, the shell includes a front plate provided with a clothes delivery opening, the front plate is a whole plate-shaped structure covering the front surface of the laundry treatment apparatus, an upper edge of the front plate is bent downwards to form a first installation surface, and atop of the front plate is fixed on the framework through the first installation surface. The front plate is an integrally formed integral plate-shaped structure covering the front surface of the laundry treatment apparatus, so that the laundry treatment apparatus has an integral whole
(Continued)

appearance. The front plate and the framework are stably fixed into a whole, and gaps are prevented from being formed in the front, the back and two sides of the front plate of the laundry treatment apparatus.

10 Claims, 10 Drawing Sheets

(56) References Cited

U.S. PATENT DOCUMENTS

| | | | | |
|---|---|---|---|---|
| 2007/0159034 | A1 | 7/2007 | Funcken et al. | |
| 2008/0141558 | A1* | 6/2008 | Bae | D06F 58/203 34/595 |
| 2012/0005918 | A1* | 1/2012 | Kim | D06F 58/38 34/491 |
| 2012/0260520 | A1* | 10/2012 | Hong | D06F 58/30 34/604 |
| 2021/0054961 | A1* | 2/2021 | Xing | F16M 13/02 |

FOREIGN PATENT DOCUMENTS

| | | | |
|---|---|---|---|
| DE | 2840939 | C2 | 7/1983 |
| DE | 3543748 | A1 | 6/1986 |
| EP | 0050066 | A1 | 4/1982 |
| EP | 0943721 | A1 | 9/1999 |
| EP | 1424429 | A1 | 6/2004 |
| GB | 1053878 | A | 1/1967 |
| JP | H05184790 | A | 7/1993 |
| JP | H08299684 | A | 11/1996 |
| JP | 2004065961 | A | 3/2004 |
| WO | 2006110006 | A1 | 10/2006 |
| WO | 2010029070 | A | 3/2010 |

OTHER PUBLICATIONS

Written Opinion (PCT/ISA/237) dated May 8, 2019, by the Chinese Patent Office as the International Searching Authority for International Application No. PCT/CN2019/074143.

* cited by examiner

LAUNDRY TREATMENT APPARATUS

TECHNICAL FIELD

The disclosure relates to the field of household appliances, in particular to a laundry treatment apparatus with integral appearance effect.

BACKGROUND

With the development of the personal society, people have higher and higher requirements on the appearance of household appliances. In the competitive selling of home appliances, people can select the favorite appearance of the home appliances. The structural design of the household appliances influences whether the household appliances are sold well. The existing laundry treatment apparatus, particularly the clothes dryer, comprises various types. The front plate is usually arranged on the lower portion of the front surface of the existing laundry treatment apparatus, the control panel is arranged on the upper portion of the front plate, a gap is formed between the bottom end of the control panel and the top end of the front plate on the front surface of the laundry treatment apparatus, which not only affects the appearance but also makes the structure of the front plate of the laundry treatment apparatus complex and poor structural stability. In order to achieve the effect of integrating the whole clothes treatment apparatus, the front plate of the clothes treatment apparatus can be provided as an integrated structure, that is, the front plate is an integrated plate, which covers the whole front surface of the clothes treatment apparatus. However, when the front plate is provided as an integrated structure, it is difficult to achieve a stable fixing effect, because the upper side of the front plate directly contacts with the table top of the clothes treatment apparatus, and therefore, the installation method in the prior art cannot be used, for example, a flanging is formed on the upper portion of the front plate of the clothes treatment apparatus and directly overlaps on the framework of the box body, and then a control panel is installed above the front plate to shield the flanging. It is also not possible to directly set a parallel protruding connection lug on the top of the front plate as some clothes treatment apparatuses, and the protruding lug is fixed on the framework inside the clothes treatment apparatus to achieve the fixing of the top of the front plate. Because these clothes treatment apparatuses all have a control panel portion arranged on the top of the front plate, the connecting structure of the front plate is shielded, so the connecting structure of the front plate is simple and rough. But when the front plate is of an integrated plate-shaped structure, the existing fixing structures cannot be adopted, the appearance is not attractive, and the stability of the connecting structure is poor.

In view of the above, the present disclosure is particularly proposed.

SUMMARY

The technical problem to be solved by the disclosure is to overcome the defects of the prior art, and provide a laundry treatment apparatus, an upper edge of a front plate of the laundry treatment apparatus is bent downwards to form an installation surface, and the installation surface is fixedly connected with a framework rigidly, so that the front plate and the framework of the laundry treatment apparatus are stably fixed into a whole, and gaps are prevented from being formed on the front, the back and two sides of the front plate of the laundry treatment apparatus.

In order to solve the technical problems, the basic conception of the technical scheme adopted in the present disclosure is as follows:

A laundry treatment apparatus, includes a framework and a shell installed on the framework, the shell includes a front plate with a clothes delivery opening, the front plate is a whole plate-shaped structure covering the front surface of the laundry treatment apparatus, an upper edge of the front plate is bent downwards to form a first installation surface, atop of the front plate is fixed on the framework through the first installation surface.

In the above scheme, the front plate is an integrally formed whole plate-shaped structure covering the front surface of the laundry treatment apparatus, so that the laundry treatment apparatus has an integral whole appearance. The integrally formed front plate is not easy to fix and directly influences the structural stability of the laundry treatment apparatus, so the upper edge of the integrally formed front plate is bent downwards to form the mounting surface, the mounting surface is fixedly connected with the framework in a rigid manner, so that the front plate and the framework of the laundry treatment apparatus are stably fixed into a whole, and gaps are prevented from being formed in the front, the back and two sides of the front plate of the laundry treatment apparatus.

Preferably, it further includes an adapter, the first installation surface is fixed on the adaptor, and the adaptor is fixed on the framework.

In the scheme, the adapter realizes the conversion connection of the front plate and the framework, and simplifies the connection structure of the front plate and the framework. On the other hand, the first installation surface is a downwardly extending mounting surface, and a parallel surface is required to be arranged on the framework for fixing, so that the framework and the front plate are fixedly connected through the adapter.

Preferably, the adaptor comprises a first contact surface and a second contact surface, the first installation surface is fixedly connected with the first contact surface, and the framework is fixedly connected with the second contact surface.

In the above solution, the adapter is designed to have a first contact surface and a second contact surface respectively connected with the first installation surface and the frame, so as to implement the switching connection between the frame and the front plate.

Preferably, the adaptor comprises a first contact surface and a second contact surface which are perpendicular to each other, the first contact surface is horizontally fixed at the top end of one side, which is matched with the front plate, of the framework; the second contact surface is a perpendicular surface, is attached to the first installation surface, and is fixed with the first installation surface through fasteners.

Preferably, the cross section of the adapter is groove-shaped, and the edge positioned on the outer side is higher than the edge positioned on the inner side, which facilitates the transfer from the framework to the front plate. The adapter is arranged on the top of the framework and is located at the edge of the side cooperated with the front plate, thus forming a first contact surface on the framework which is in contact with the first installation surface.

Preferably, at least the edge part of the first installation surface is a vertical plane so as to be attached to the second contact surface and fixed through fasteners.

The adapter can comprise a plurality of adapter pieces, the adapter pieces are fixed on the edge of the front surface of the top of the framework at intervals, and a connecting structure is arranged on the first contact surface of each adapter piece to be connected and fixed with the first installation surface of the front plate. Or the framework is only provided with one adapter, and the adapter extends along the length direction of the framework at the top of the framework so as to be fixedly contacted with the front plate.

Preferably, the adaptor is of a long strip-shaped structure, the first contact surface and the second contact surface are both long strip-shaped surfaces, a plurality of screw holes are formed in the first contact surface at intervals along the length direction, and the first installation surface is correspondingly provided with screw holes for connection and fixation through screws.

Preferably, the first installation surface and the first contact surface are further provided with a pre-positioning structure, the pre-positioning structure comprises a horizontal flanging arranged on the first contact surface and a slot arranged on the first installation surface, and the horizontal flanging is inserted into the slot to realize pre-positioning of the adaptor and the front plate.

In the above scheme, the pre-positioning of the adaptor and the front plate is realized through the pre-positioning structure, which facilitates the subsequent fixing and assembling processes of the adaptor and the front plate.

Preferably, the two side edges of the front plate are respectively bent towards the other opposite side to form a second mounting surface, and the second mounting surfaces are fixed on the framework and/or the adapter.

Preferably, two ends of the first contact surface of the adaptor are respectively fixed on the second mounting surface through fasteners;

Preferably, the edges of the two ends of the first contact surface of the adapter are respectively provided with a screw hole, and the second mounting surfaces on the two sides of the front plate are respectively and correspondingly provided with a screw hole so as to be fixed on the first contact surface through screws.

Preferably, the second mounting surface partially protrudes towards the first contact surface to form a partially vertical plane, and the vertical plane is attached to the first contact surface and fastened by screws.

In above-mentioned scheme, a vertical plane is arranged on the second mounting surface, which is beneficial to fit and fixed with the first contact surface of adaptor, so as to improve the fixation and stability effect.

Preferably, the framework comprises four vertically arranged reinforcing members, and the tops of the two reinforcing members cooperated with the front plate are connected with a beam, and the adapter is fixed on the beam.

Preferably, the beam covers the top end surfaces of the two reinforcing pieces, forms a horizontal surface on the framework, and the second contact surface of the adapter piece is attached to the horizontal surface and is connected and fixed by fasteners.

After adopting the technical scheme, compared with the prior art, the disclosure has the following beneficial effects:

1. The laundry treatment apparatus comprises a framework and a shell arranged on the framework, the shell comprises a front plate provided with a clothes delivery opening, the front plate is of a whole plate-shaped structure covering the front surface of the laundry treatment apparatus, the upper edge of the front plate is bent downwards to form a first installation surface, and the top of the front plate is fixed on the framework through the first installation surface. The front plate is an integrally formed integral plate-shaped structure covering the front surface of the laundry treatment apparatus, so that the laundry treatment apparatus has an integral whole appearance, the integrally formed front plate is not easy to fix and directly influences the structural stability of the laundry treatment apparatus. In the disclosure, the upper edge of the front plate is bent downwards to form the mounting surface, the mounting surface is fixedly connected with the framework in a rigid manner, so that the front plate and the framework of the laundry treatment apparatus are stably fixed into a whole, and gaps are prevented from being formed in the front, the back and two sides of the front plate of the laundry treatment apparatus. 2. According to the disclosure, the laundry treatment apparatus comprises a framework and an adapter, the first installation surface is fixed on the adapter, and the adapter is fixed on the framework. The adapter realizes the switching connection between the front plate and the framework, and simplifies the connection structure between the front plate and the framework. On the other hand, the first installation surface is a downwardly extending mounting surface, and a parallel surface is required to be arranged on the framework for fixing. Therefore, the present disclosure provides an adapter to realize the connection and fixation of the framework and the front plate. The adapter comprises a first contact surface and a second contact surface, the first installation surface is fixedly connected with the first contact surface, and the framework is fixedly connected with the second contact surface. The adapter is designed to have a first contact surface and a second contact surface which are respectively connected with the first installation surface and the framework, so as to realize the switching connection between the framework and the front plate.

3. The adapter comprises a first contact surface and a second contact surface which are vertical to each other, and the first contact surface is horizontally fixed at the top end of one side, which is matched with a front plate, of a framework; and the second contact surface is a vertical surface, which fits with the first installation surface and is fixed through fasteners. The cross section of the adapter is groove-shaped, and the edge positioned on the outer side is higher than the edge positioned on the inner side, which facilitates the transfer from the framework to the front plate. The adapter is arranged on the top of the framework and is located at the edge of the side cooperated with the front plate, thus forming a first contact surface on the framework which is in contact with the first installation surface.

The following describes embodiments of the present disclosure in further detail with reference to the accompanying drawings.

BRIEF DESCRIPTION OF THE DRAWINGS

The accompanying drawings, as part of the present disclosure, are used to provide a further understanding of the disclosure. The illustrate embodiment(s) of the disclosure and the description thereof are used to explain the disclosure, but do not constitute improper limitation of the disclosure. It is obvious that the drawings in the following description are only some embodiments and that for a person skilled in the art, other drawings can also be derived from them without inventive effort. In the drawings.

Figure 1:
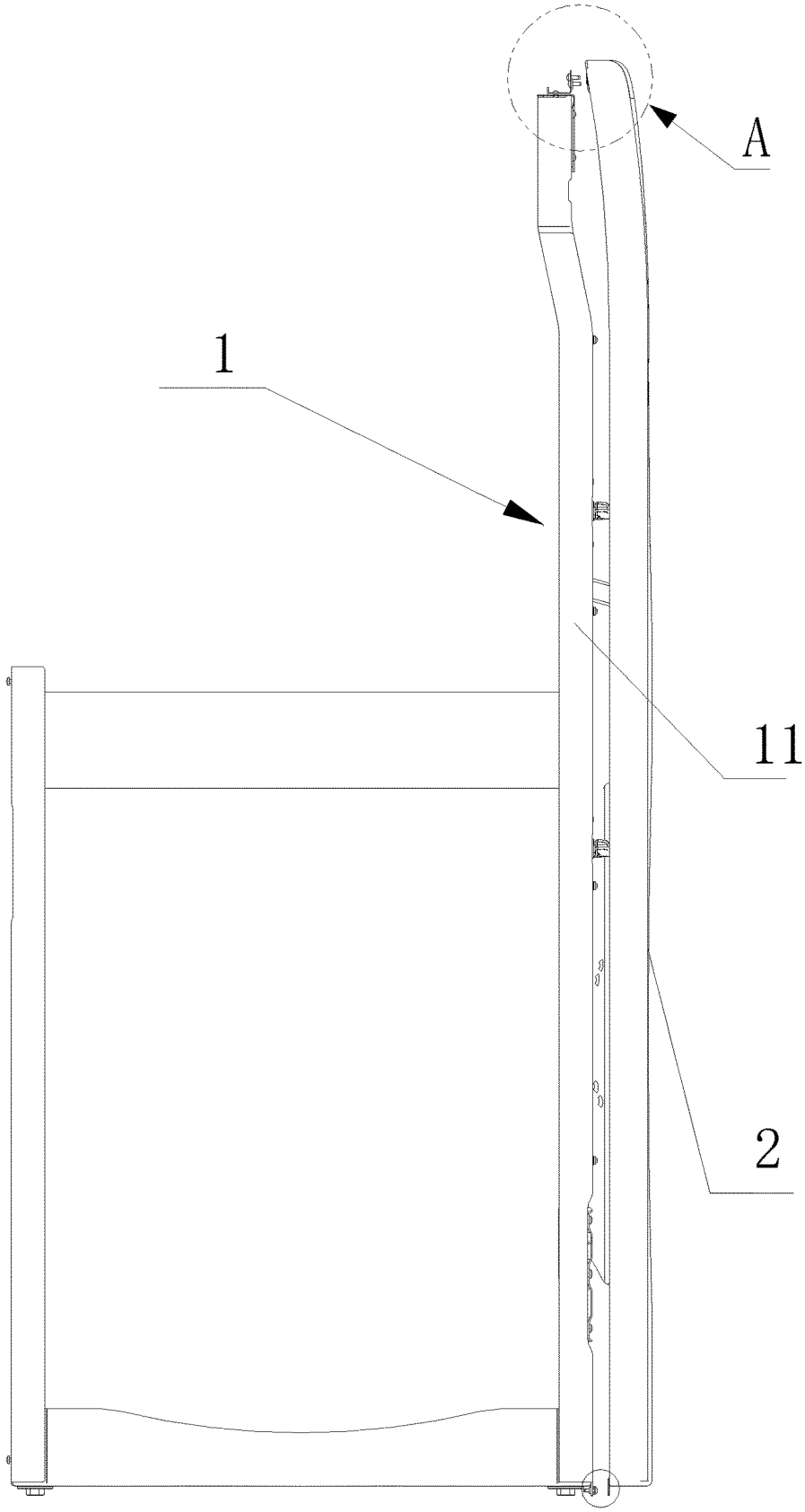
FIG. 1 is a side view of a structure for coupling a framework and a front panel of the laundry treatment apparatus according to the present disclosure.

In the figure: 1. a framework; 11. a reinforcing member; 12. a beam; 2. a front plate; 21. a first installation surface; 211. inserting slots; 22. a second mounting surface; 221. a vertical plane; 222. a lug; 3. an adaptor; 31. a first contact surface; 32. a second contact surface; 33. horizontally flanging; 34. screw holes; 4. a first clothes delivery opening; 5. a second clothes delivery opening.

It should be noted that the drawings and the description are not intended to limit the scope of the inventive concept in any way, but rather to illustrate it for those skilled in the art by reference to specific embodiments.

DETAILED DESCRIPTION

In order to enable the purpose, the technical solution and advantages of the embodiments of the present disclosure to be clearer, the technical solutions in embodiments of the present disclosure will be completely and clearly described below in conjunction with drawings in embodiments of the present disclosure. The embodiments below are used for description of the present disclosure, yet without restricting the scope of the present disclosure.

In the description of the present disclosure, it should be noted that the orientation or position relationship indicated by terms like "up", "down", "inner" and "outer" is orientation or position relationship indicated based on drawings, just for facilitating description of the present disclosure and simplifying the description, rather than indicating or hinting that the device or element indicated must have a specific orientation and must be configured and operated at a specific orientation. Thus, it cannot be understood as restriction to the present disclosure.

In the description of the present disclosure, it should be noted that unless otherwise prescribed and defined clearly, terms like "mounting" and "connection" should be understood in a broad sense. For example, it may be fixed connection and may also be detachable connection or integral connection; it may be mechanical connection and may also be electrical connection; it may be direct connection and may also be indirect connection through an intermediary. For those skilled in the art, the specific meanings of the above terms in the present disclosure can be understood depending on specific situations.

Referring to FIGS. 1 to 10, the present disclosure provides a laundry treatment apparatus, comprising a framework 1 and a shell mounted on the framework 1, the shell comprises a front plate 2 provided with a clothes delivery opening, the front plate 2 is a whole plate-shaped structure covering the front surface of the laundry treatment apparatus laundry treatment apparatus, the upper edge of the front plate 2 is bent downwards to form a first installation surface 21, and the top of the front plate 2 is fixed on the framework 1 through the first installation surface 21.

The laundry treatment apparatus comprises a first clothes treatment device and a second clothes treatment device which are arranged up and down, a shell of the laundry treatment apparatus comprises a side plate which surrounds the side parts of the two clothes treatment devices, a rear cover plate which covers the back sides of the two clothes treatment devices, a table top which covers the tops of the two clothes treatment devices and a front plate 2 which is positioned at the front parts of the two clothes treatment devices and is tightly connected with the table top and the side plate. The front plate 2 is of a whole plate-shaped structure, and a first clothes delivery opening 4 and a second clothes delivery opening 5 are respectively formed in the front plate corresponding to the first clothes treatment device and the second clothes treatment device.

In the above solution, the first and second clothes treatment devices may be a drying drum or a washing drum, or one of them is a drying drum and the other is a washing drum, wherein the front panel is designed as a one-piece plate-shaped structure, so that the laundry treatment apparatus has an integral appearance effect.

In the disclosure, the front plate 2 is an integrally formed integral plate-shaped structure covering the front surface of the laundry treatment apparatus, so that the laundry treatment apparatus has an integral whole appearance, the integrally formed front plate 2 is not easy to fix and directly influences the structural stability of the laundry treatment apparatus, therefore, the upper edge of the integrally formed front plate 2 is bent downwards to form a mounting surface, and the mounting surface is rigidly and fixedly connected with the framework 1, so that the front plate 2 and the framework 1 of the laundry treatment apparatus are stably fixed into a whole, and gaps are prevented from being formed in the front, the back and two sides of the front plate 2 of the laundry treatment apparatus.

Figure 2:
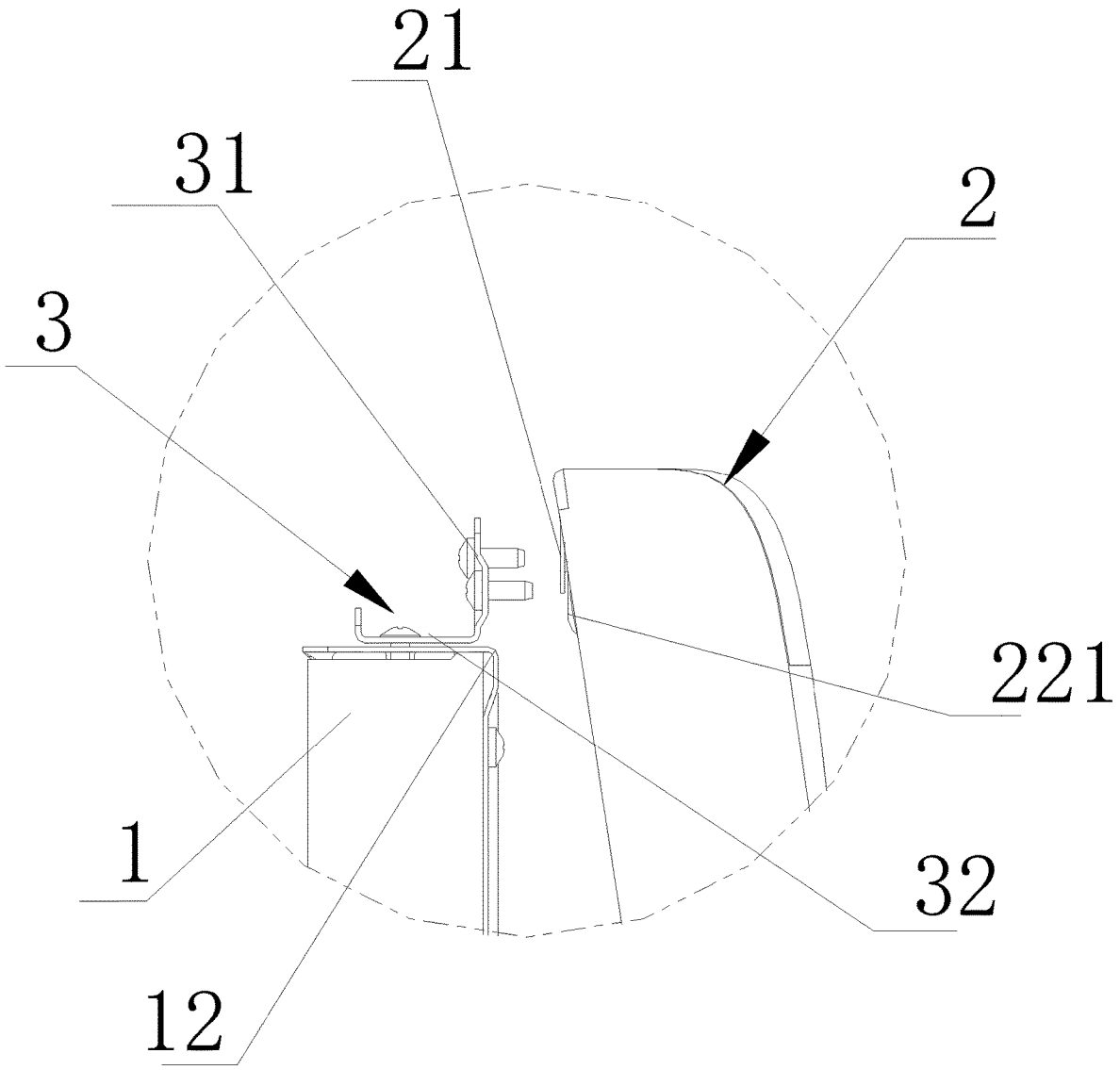
FIG. 2 is an enlarged view of portion A of FIG. 1.
Figure 4:
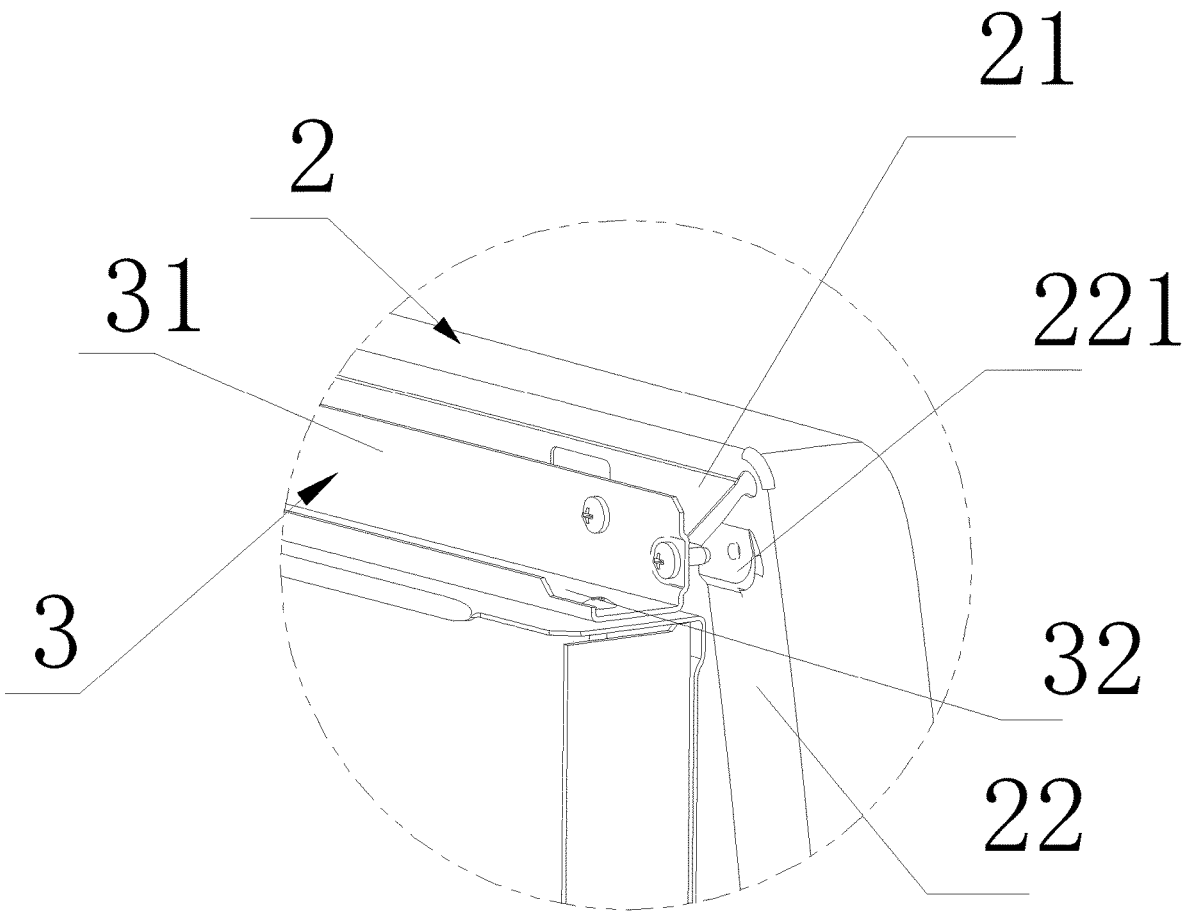
FIG. 4 is an enlarged view of portion B of FIG. 3.
Figure 8:
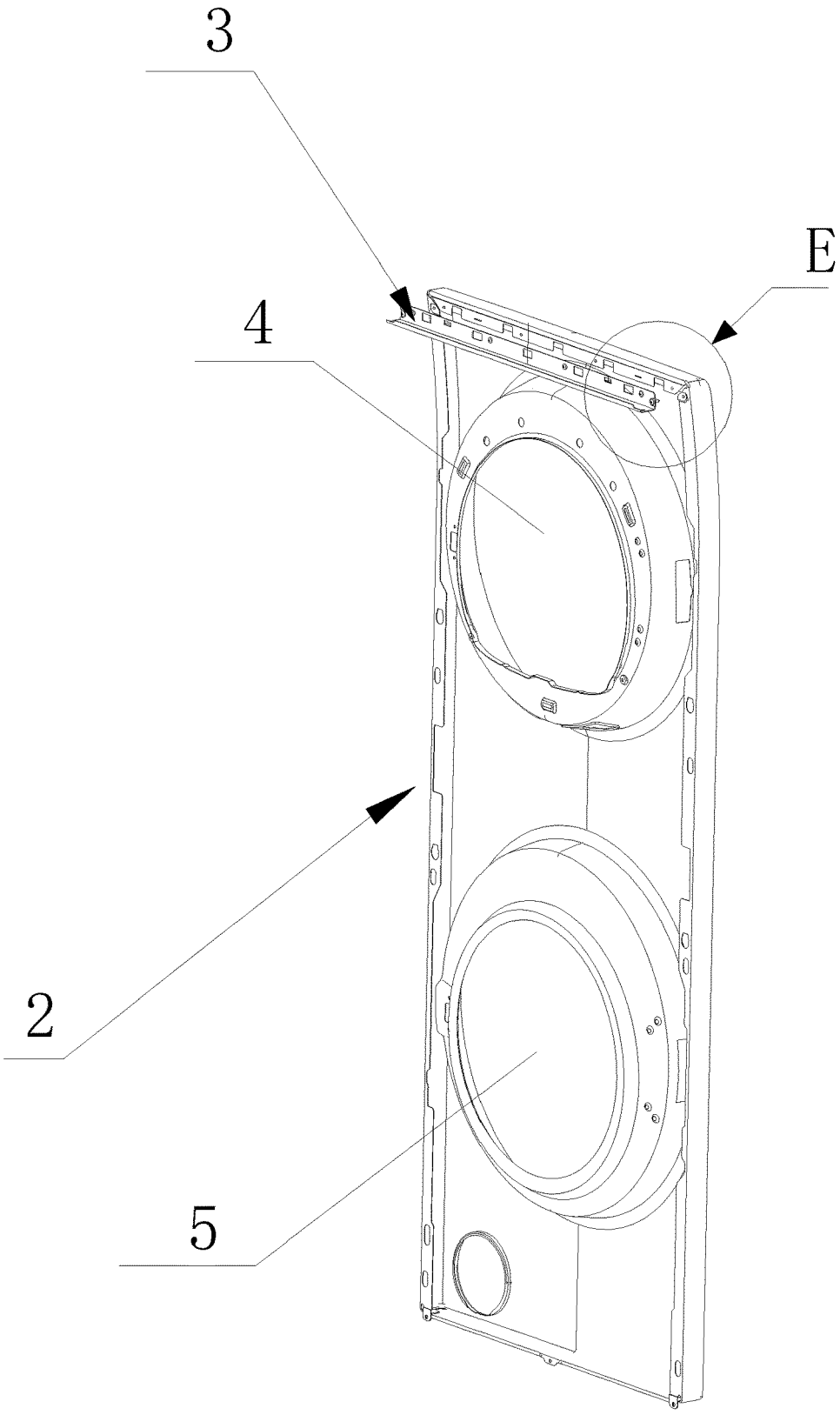
FIG. 8 is another view of FIG. 6.
Figure 9:
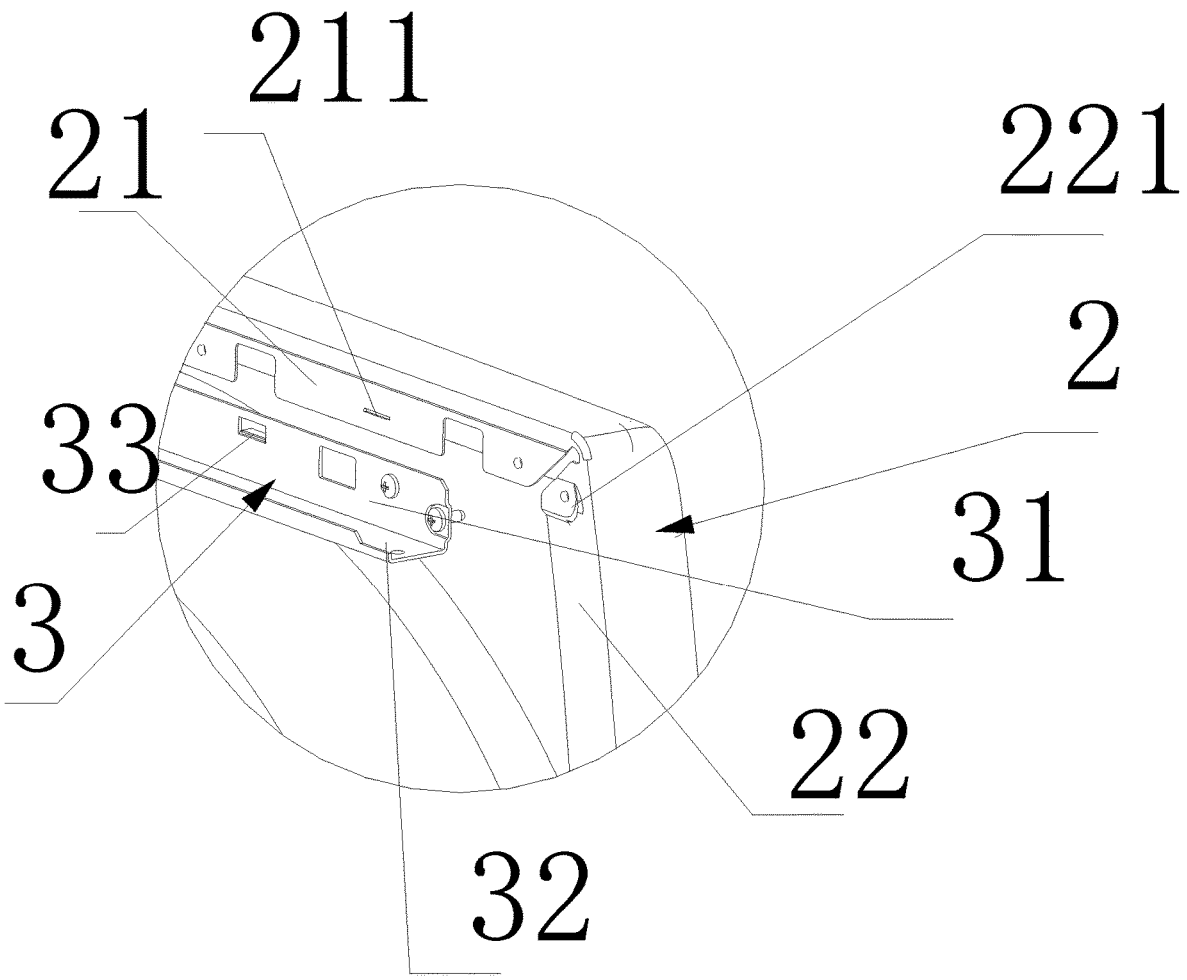
FIG. 9 is an enlarged view of section E of FIG. 8.

Preferably, as shown in FIGS. 2, 4 and 8, the laundry treatment apparatus further comprises an adaptor 3, the first installation surface 21 is fixed on the adaptor 3, and the adaptor 3 is fixed on the framework 1.

In the scheme, the front plate 2 is connected with the framework 1 in a switching way through the adapter 3, so that the connection structure of the front plate 2 and the framework 1 is simplified. On the other hand, the first installation surface 21 is a downwardly extending mounting surface, and a parallel surface is required to be arranged on the framework 1 for fixing, so that the adapter 3 is arranged to realize the adapter fixing of the framework 1 and the front plate 2.

Figure 7:
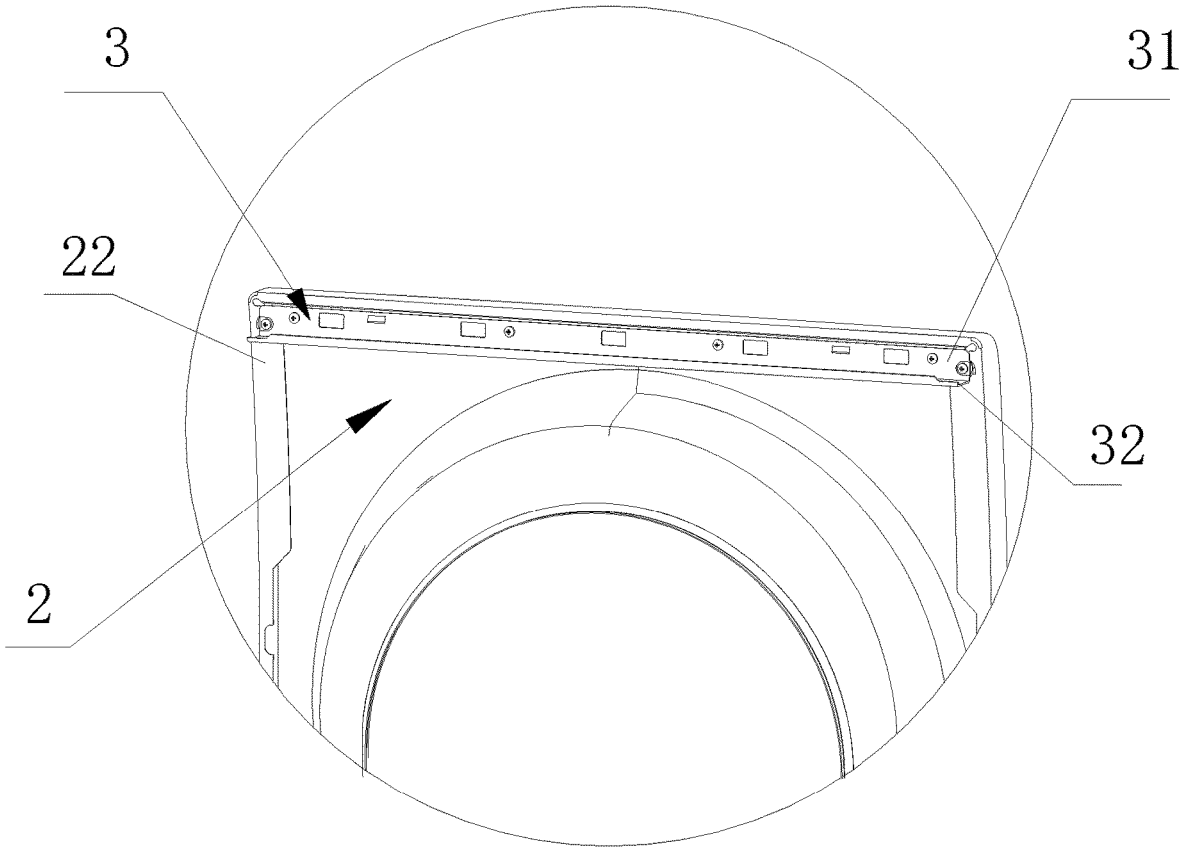
FIG. 7 is an enlarged view of portion D of FIG. 6.

Preferably, referring to FIGS. 2, 4 and 7, the adaptor 3 includes a first contact surface 31 and a second contact surface 32, the first installation surface 21 is fixedly connected to the first contact surface 31, and the framework 1 is fixedly connected to the second contact surface 32.

In the above solution, the adaptor 3 is designed to have a first contact surface 31 and a second contact surface 32 connected to the first installation surface 21 and the frame 1, respectively, so as to achieve the switching connection of the frame 1 to the front plate 2.

Preferably, the cross section of the adaptor 3 is groove-shaped, and the adaptor 3 includes a first contact surface 31 and a second contact surface 32 which are perpendicular to each other, the first contact surface 31 is horizontally fixed on the top end of one side, which is matched with the front plate 2, of the framework 1, and the second contact surface 32 is a perpendicular surface, is attached to the first installation surface 21, and is fixed with the first installation surface by fasteners;

In the above scheme, the cross section of the adapter 3 is groove-shaped, and the edge of the groove-shaped part positioned on the outer side is higher than the edge positioned on the inner side, which facilitates the transfer connection of the front plate 2 with the framework 1. The adaptor 3 is arranged on the top of the framework 1 at the edge of the side matched with the front plate 2, so that a first contact surface 31 in contact connection with the first installation surface 21 is formed on the framework 1.

Preferably, at least the edge of the first installation surface 21 is a vertical plane 221, so as to be attached to the second contact surface 32 by a fastener.

In one embodiment, the adaptor 3 may include a plurality of adaptors 3, a plurality of adaptors 3 are fixed at intervals on the edge of the top front surface of the framework 1, and the first installation surface 21 on each adaptor 3 is provided with a connecting structure for connecting and fixing with the first installation surface 21 on the front plate 2. In a preferred embodiment, the laundry treatment apparatus is provided with only one adaptor 3, and the adaptor 3 is extended along the length direction of the framework 1 on the top of the framework so as to be contacted and fixed with the front plate 2. By providing an adapter 3, a flat mounting surface, i.e. the first contact surface 31, can be formed, so that the adapter can be matched and fixed with the first installation surface 21 on the front plate, and a stable fixing effect can be provided for the front plate 2.

Preferably, the adaptor 3 is a long strip structure, the first contact surface 31 and the second contact surface 32 are both long strip surfaces, a plurality of screw holes are arranged on the first contact surface 31 at intervals along the length direction, and the first installation surface 21 is correspondingly provided with screw holes for being connected and fixed through screws. On the other hand, the second contact surface 32 is also provided with a plurality of screw holes along the length direction thereof so as to be fixed to the frame 1 by screws.

Preferably, the first installation surface 21 and the first contact surface 31 are further provided with a pre-positioning structure, the pre-positioning structure include a horizontal flange 33 arranged on the first contact surface 31 and a slot 211 arranged on the first installation surface 21, and the horizontal flange 33 is inserted into the slot 211 to realize pre-positioning of the adaptor 3 and the front plate 2. The horizontal flanging can be a horizontal flanging formed by partially folding of the upper edge of the first contact surface, or a square groove is formed in the middle of the first contact surface to form the flanging.

In the scheme, the adaptor 3 and the front plate 2 are pre-positioned through the pre-positioning structure, so that the following fixing and assembling processes of the adaptor and the front plate are facilitated. Preferably, the first contact surface 31 is provided with a plurality of said horizontal flanges at intervals along its length, thereby providing a predetermined positioning stability.

Preferably, as shown in FIG. 4, two side edges of the front plate 2 are respectively bent toward the opposite side to form a second mounting surface 22, and the second mounting surface 22 is fixed on the framework 1 and/or the adaptor 3.

Figure 10:
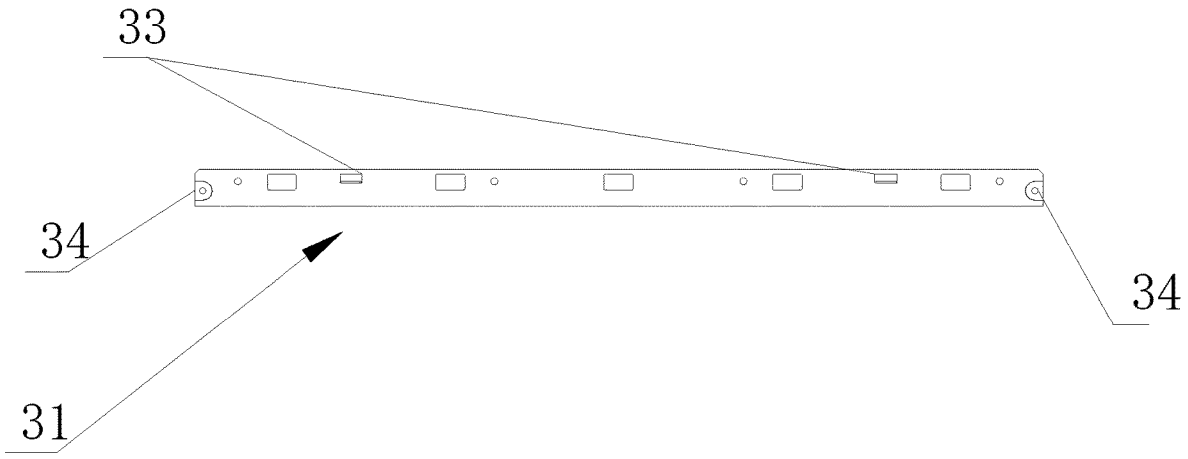
FIG. 10 is a schematic view of a first contact surface structure of the adapter of the present disclosure.

Preferably, two ends of the first contact surface 31 of the adaptor 3 are respectively fixed on the second mounting surface 22 by fasteners;

Preferably, as shown in FIG. 4 and FIG. 10, a screw hole 34 is respectively formed at two end edges of the first contact surface 31 of the adaptor 3, and screw holes are respectively correspondingly formed in the second mounting surfaces 22 at two sides of the front plate 2, so as to be fixed on the first contact surface 31 by screws;

Preferably, the second mounting surface 22 partially protrudes toward the first contact surface 31 to form a partially vertical plane 221, and the vertical plane 221 is attached to the first contact surface 31 and fastened by screws.

In the above scheme, the vertical plane 221 is arranged on the second mounting surface 22, which is beneficial to fit and fixed with the first contact surface 31 of the adaptor 3, so as to improve the fixation and stability effect.

In addition, the second mounting surfaces 22 on the two sides of the front plate 2 are bending surfaces formed by bending the edges of the two sides of the front plate 2, the second mounting surfaces 22 are provided with a screw hole at the top thereof to be connected and fixed with the first contact surface 31, and the lower part of the second mounting surfaces 22 is also provided with a plurality of fixing structures to be connected and fixed with the framework 1, and the fixing structures can be screw holes or clamping grooves to be clamped on the framework 1.

Figure 3:
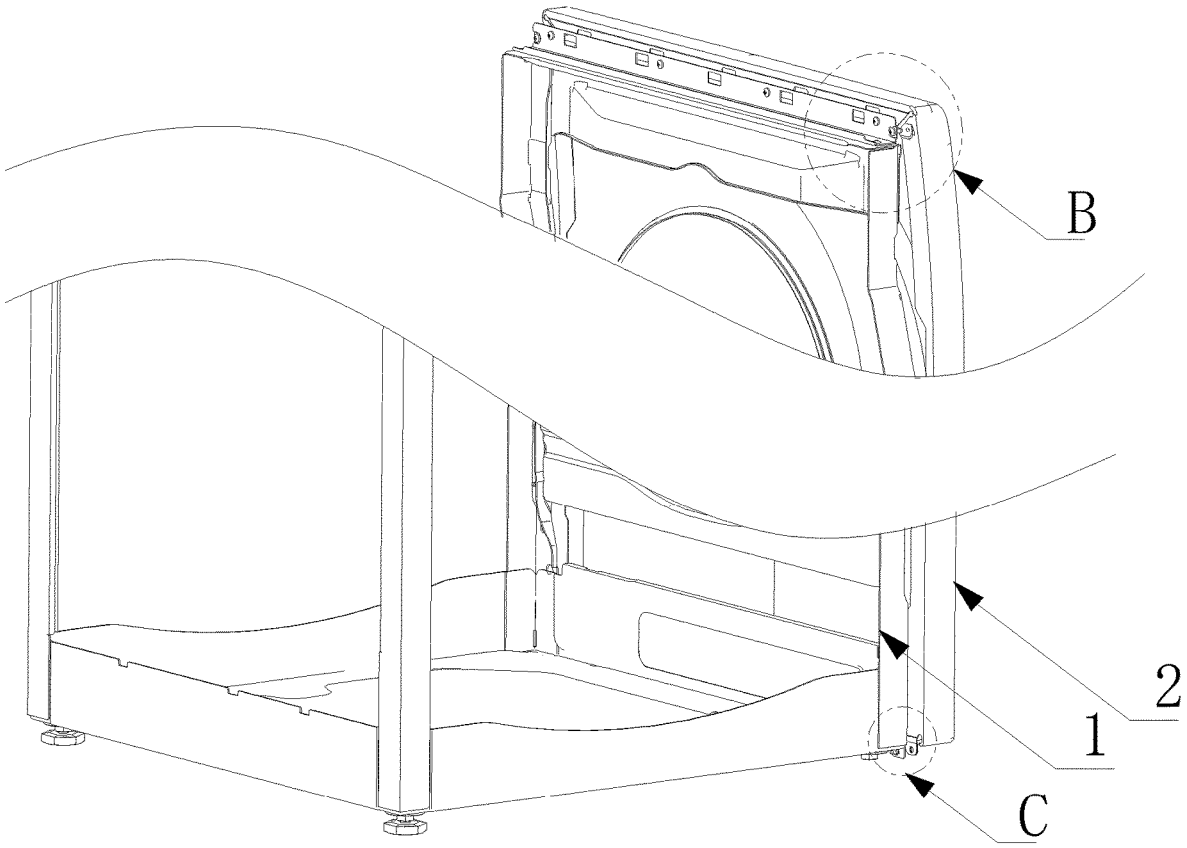
FIG. 3 is another structural view of the connecting structure of the framework and the front plate of the present disclosure.

Preferably, as shown in FIGS. 1, 2, and 3, the framework 1 includes four vertically disposed reinforcing members 11, a beam 12 is connected to the top of the two reinforcing members 11 that are cooperated with the front plate 2, and the adaptor 3 is fixed on the beam 12.

Preferably, the beam 12 covers top end surfaces of the two reinforcing members 11 and forms a horizontal surface on the framework 1, and the second contact surface 32 of the adaptor 3 is attached to the horizontal surface and is connected and fixed through fasteners.

Figure 5:
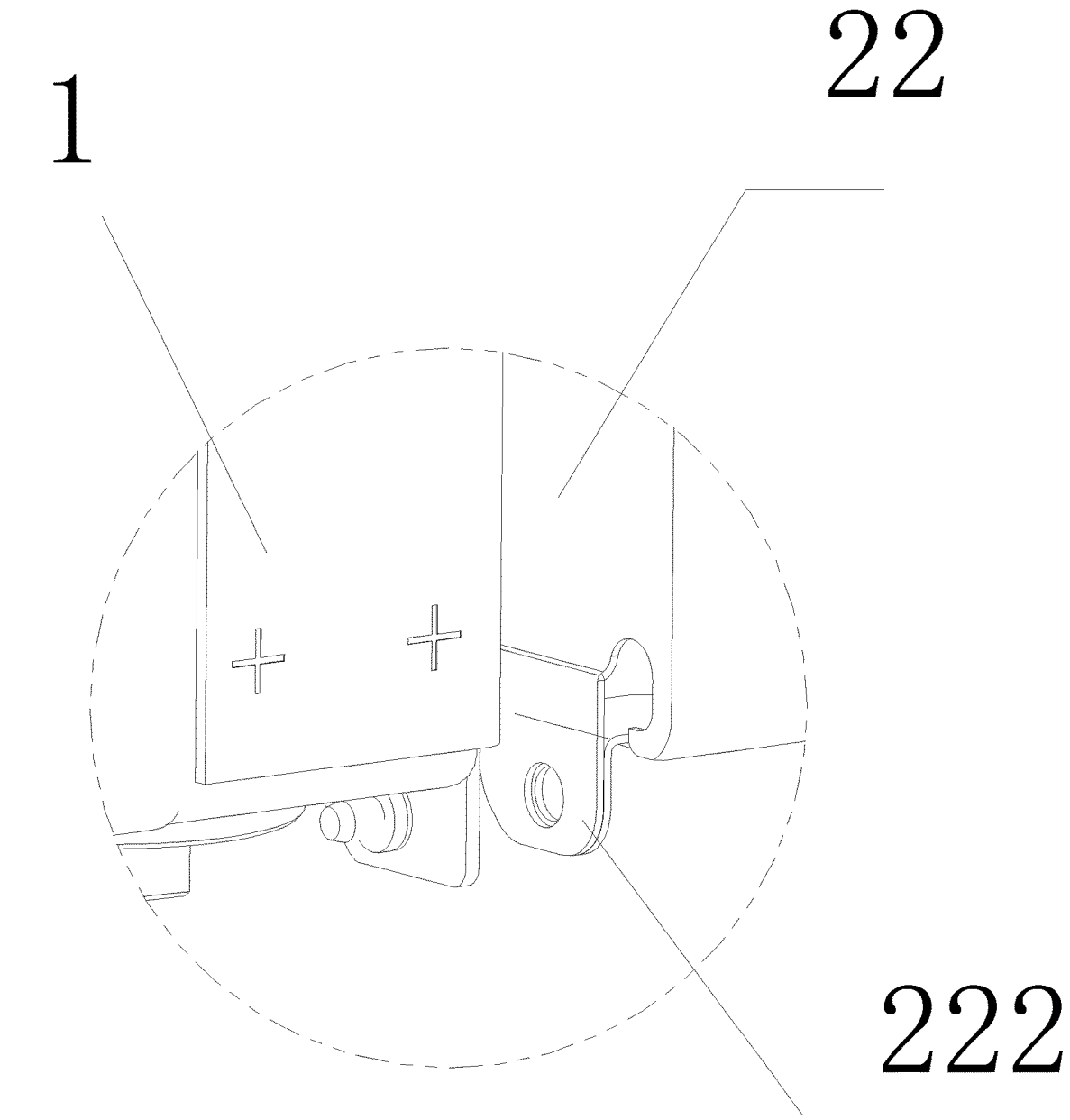
FIG. 5 is an enlarged view of the portion C of FIG. 3.
Figure 6:
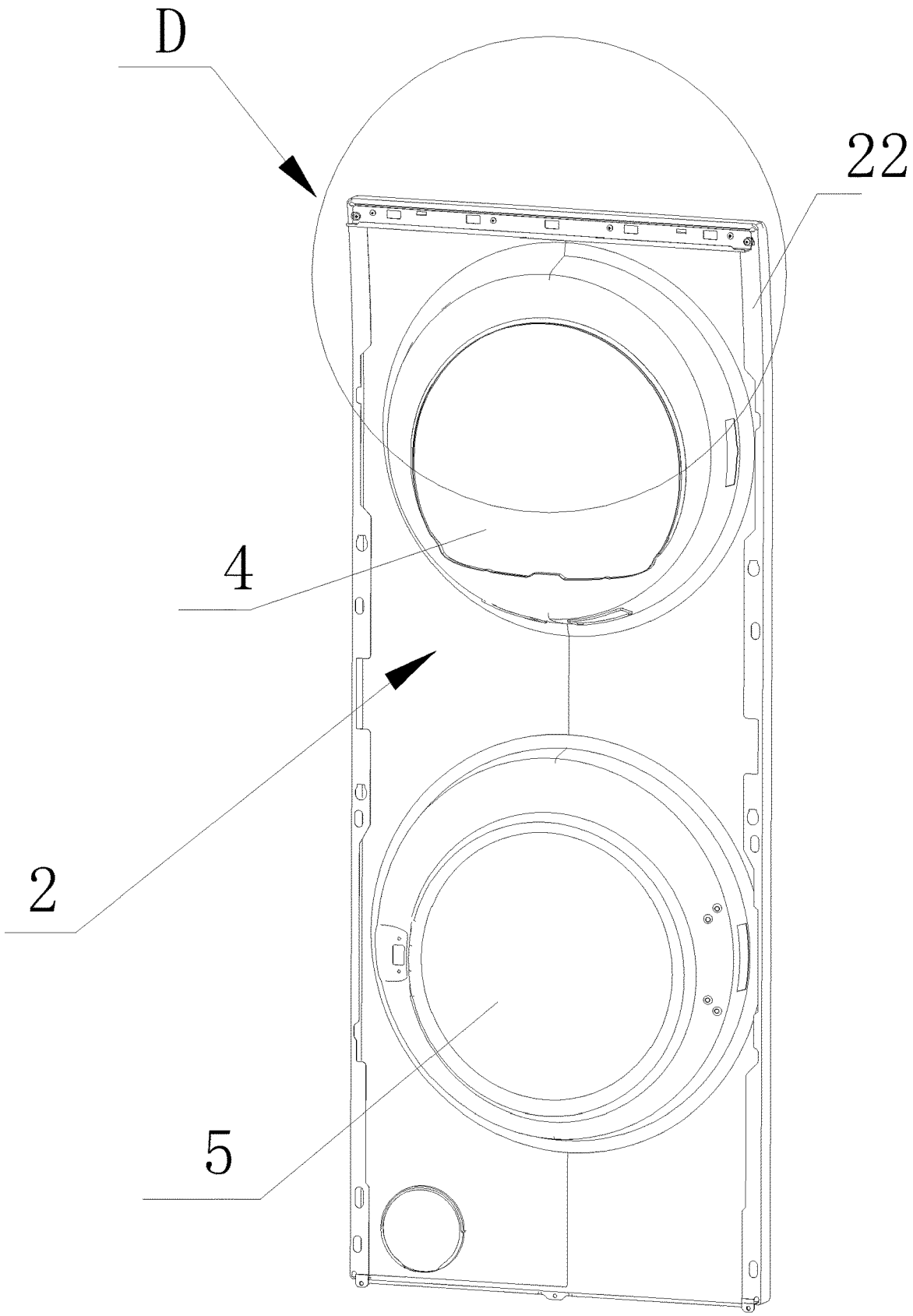
FIG. 6 is a schematic view of the back structure of the front plate of the present disclosure.

Further, referring to FIGS. 3 and 5, the bottom of the front plate 2 is clamped or fixed to the framework 1 by fasteners, and preferably, the bottom of the front plate 2 is provided with a lug 222 protruding downward, and the lug 222 is provided with a hole to be connected and fixed with the framework 1.

The framework 1 comprises four vertically arranged reinforcing members 11, the bottoms of the two reinforcing members 11 cooperated with the front plate 2 are connected with a beam 12, the adapter 3 is fixed on the beam 12, two ends of the beam 12 extend downwards and are also provided with lugs, and the lugs are attached to lugs 222 on the front plate 2 and fastened through screws. The lugs 222 on the front plate 2 protrude from the body of the front plate 2, so that screws can be mounted from the surface of the front plate 2 during mounting, simplifying the connection structure.

In the installation process, the front plate 2 and the adaptor 3 are fixed firstly, and then the front plate 2 connected with the adaptor 3 is fix on the framework 1. The installation process is simple, and the second contact surface on the adaptor is easy to overlap on the framework, which is conducive to positioning and installation.

Embodiment II

The difference between the second embodiment and the first embodiment is that: the laundry treatment apparatus does not have the adaptor 3, the upper edge of the front plate 2 of the laundry treatment apparatus is bent downwards and then is bent towards the outer side horizontally to form a horizontal plane which is fixedly connected with the framework 1. So that the structural effect that the front plate 2 and the adaptor are connected into a whole in the first embodiment is formed. The framework 1 also comprises four vertically arranged reinforcing members 11, the tops of the two reinforcing members 11 matched with the front plate 2 are connected with a beam 12. And the horizontal plane is attached and fixed on the beam 12. In the scheme, the material for bending the horizontal plane needs to be reserved in the plate for manufacturing the front plate 2.

After the upper edge of the front plate 2 is bent downward once, the formed bending surface continues to bend to the interior of the laundry treatment apparatus for the second time to form the horizontal plane, which is clamped and/or fixed on the framework 1 through fasteners. Two sides of the front plate 2 are bent inward to form the second mounting surface 22, as in the first embodiment. In this embodiment, the adapter 3 is not set separately, so that the front plate 2 is directly fixed on the frame 1, which simplifies the installation process, and the integrated design makes the structure more stable.

Although the present disclosure has been described with reference to the preferred embodiments, it will be understood by those skilled in the art that various changes may be made and equivalents may be substituted for elements thereof without departing from the scope of the present disclosure.

The invention claimed is:

1. A laundry treatment apparatus, comprising:

a framework;

a shell installed on the framework; and an adaptor wherein, the shell includes a front plate provided with a clothes delivery opening, the front plate is a plate-shaped structure covering a front surface of the laundry treatment apparatus, an upper edge of the front plate is bent downwards to form a first installation surface, and a top of the front plate is fixed on the framework through the first installation surface and the adaptor includes a first contact surface and a second contact surface, the first contact surface is perpendicular to the second contact surface, the second contact surface is horizontally fixed on a top end of a side of the framework cooperating with the front plate, and the first contact surface is attached to the first installation surface and fixed by a fastener.

2. The laundry treatment apparatus according to claim 1, wherein the adaptor is a strip structure, the first contact surface and the second contact surface are both strip surfaces, screw holes are formed in the first contact surface at intervals along a length direction, and the first mounting installation surface is provided with screw holes for connection and fixation through screws.

3. The laundry treatment apparatus according to claim 2, wherein the first installation surface and the first contact surface are provided with a pre-positioning structure, the pre-positioning structure comprises a horizontal flange arranged on the first contact surface and a slot arranged on the first installation surface, and the horizontal flange is inserted into the slot to pre-position the adaptor and the front plate.

4. The laundry treatment apparatus according to claim 1, wherein the first installation surface and the first contact surface are provided with a pre-positioning structure, the pre-positioning structure comprises a horizontal flange arranged on the first contact surface and a slot arranged on the first installation surface, and the horizontal flange is inserted into the slot to pre-position the adaptor and the front plate.

5. The laundry treatment apparatus according to claim 1, wherein two side edges of the front plate are respectively bent towards an opposite side to form second mounting surfaces, and the second mounting surfaces are fixed on the framework and/or the adapter.

6. The laundry treatment apparatus according to claim 5, wherein two ends of the first contact surface of the adaptor are respectively fixed on the second mounting surface by fasteners.

7. The laundry treatment apparatus according to claim 6, wherein two ends of the first contact surface of the adapter are respectively provided with a screw hole, and the second mounting surfaces of the two sides of the front plate are respectively provided with screw holes to be fixed on the first contact surface through screws.

8. The laundry treatment apparatus according to claim 6, wherein the second mounting surface partially protrudes towards the first contact surface to form a vertical plane, and the vertical plane is engaged with the first contact surface and fastened by screws.

9. The laundry treatment apparatus according to claim 1, wherein the framework includes four reinforcing members vertically disposed, a beam is connected to tops of two reinforcing members engaged with the front plate, and the adaptor is fixed to the beam.

10. The laundry treatment apparatus according to claim 9, wherein the beam covers top surfaces of the two reinforcing members to form a horizontal surface on the framework, and the second contact surface of the adapter member is engaged with the horizontal surface and is fixed by a fastener.

* * * * *